United States Patent [19]

Nakahara et al.

[11] Patent Number: 4,581,312

[45] Date of Patent: Apr. 8, 1986

[54] PRESSURE-FIXABLE CAPSULE TONER COMPRISING PRESSURE FIXABLE CORE MATERIAL AND VINYL POLYMER SHELL MATERIAL

[75] Inventors: Toshiaki Nakahara; Ichiro Ohsaki; Masuo Yamazaki, all of Kawasaki; Katsutoshi Wakamiya, Yokohama; Toru Matsumoto, Tokyo; Hisayuki Ushiyama, Hiratsuka, all of Japan

[73] Assignee: Canon Kabushiki Kaisha, Tokyo, Japan

[21] Appl. No.: 645,160

[22] Filed: Aug. 28, 1984

[30] Foreign Application Priority Data

Sep. 9, 1983 [JP] Japan ..... 58-166342

[51] Int. Cl.[4] ..... G03G 13/06; G03G 9/08

[52] U.S. Cl. ..... 430/102; 430/98; 430/101; 430/107; 430/109; 430/110; 430/111; 430/138; 430/904; 428/403; 428/407

[58] Field of Search ..... 430/98, 107, 138, 110, 430/111, 109, 904, 101, 102; 428/407, 403

[56] References Cited

U.S. PATENT DOCUMENTS

| | | | |
|---|---|---|---|
| 3,326,848 | 6/1967 | Clemens et al. | 430/137 |
| 3,338,991 | 8/1967 | Insalaco et al. | 430/137 |
| 3,502,582 | 3/1970 | Clemens | 430/107 X |
| 3,788,994 | 1/1974 | Wellman et al. | 430/109 |
| 4,259,426 | 3/1981 | Hasegawa et al. | 430/111 X |
| 4,265,994 | 5/1981 | Hasegawa et al. | 430/107 |
| 4,450,221 | 5/1984 | Terada et al. | 430/124 X |
| 4,473,627 | 9/1984 | Kanbe et al. | 430/102 |

*Primary Examiner*—John E. Kittle
*Assistant Examiner*—Mukund J. Shah
*Attorney, Agent, or Firm*—Fitzpatrick, Cella, Harper & Scinto

[57] ABSTRACT

A pressure-fixable capsule toner for electrophotography having characteristics such as good combination of fixability and durability and also a stable charge controlling characteristic is provided. The core materials typically are of polyethylene or paraffin wax. The shell material is a vinyl polymer characterized by low molecular weight distribution represented by a ratio of weight-average molecular weight/number average molecular weight of not larger than 3.5. The vinyl polymer is preferably a copolymer of styrene or a derivative thereof and a tertiary amino-group containing vinyl monomer.

7 Claims, 2 Drawing Figures

PRESSURE-FIXABLE CAPSULE TONER COMPRISING PRESSURE FIXABLE CORE MATERIAL AND VINYL POLYMER SHELL MATERIAL

BACKGROUND OF THE INVENTION

This invention relates to a toner to be used for electrophotography, electrostatic printing, or the like and particularly to a capsule toner adapted for pressure fixing.

Heretofore, as electrophotographic processes, a large number of processes have been known, including those disclosed in U.S. Pat. Nos. 2,297,691; 3,666,363; and 4,071,361. These processes generally use photoconductive materials and comprise the steps of forming an electrical latent image, subsequently developing the latent image with a toner, optionally transferring the resultant toner image onto a transfer material such as paper and fixing the toner image by means of heat, pressure, solvent vapor, etc. thereby to obtain a copy.

Further, several methods have also been known for developing and visualizing electrical latent images, and they are broadly classified into the dry development method and the wet development method. The former is further classified into the method wherein a two-component developer is used and the method wherein a one-component developer is used.

Belonging to the two component developer method, the magnetic brush method using an iron powder carrier and the cascade method, using a bead carrier which are different in respect of carriers, have been widely practiced. Both of these methods are excellent because they provide good quality of images in a relatively stable manner, whereas they have disadvantages inherent to the two component developer method that the quality of the image changes according to the change in mixing ratio between the toner and the carrier.

In order to obviate the drawbacks as mentioned above, several types of development methods using one-component developers have been proposed, among which those methods using magnetic toners are generally excellent and have been put into commercial practice. As a development method using a magnetic one-component developer, the magnedry method using an electroconductive toner shows stable development characteristic but involves some problem in transfer performance to such a transfer material as so-called plain paper.

In contrast to the above, there are known several methods using high-resistivity magnetic toners having good transferability, including one wherein dielectric polarization of toner particles is utilized, and one wherein charge is transferred through turbulence of toner particles. These methods, however, involve a problem in stability of development.

Further, in recent years, a research group to which we belong has developed several development methods as disclosed in Japanese Patent Kokai Nos. 54-42141 and 55-18656 wherein toner particles are caused to jump onto the latent image to develop the latter. More specifically, in this type of developing methods, magnetic toner is applied as a very thin coating layer onto a sleeve which is a toner carrying and charging member, the coated toner layer is triboelectrically charged, and the toner layer is driven under the action of a magnetic field to a close approximity with but held non-contacting the electrostatic latent image, whereby the development is effected. According to this method, the toner is sufficiently triboelectrically charged by forming a very thin layer of a magnetic toner on a sleeve to increase the opportunity for contact between the toner and the sleeve. The toner is held by a magnetic force, and the aggregation of the toner particles are loosened by relative movement between the toner and the magnet. The toner held by the magnetic force is caused to face the electrostatic image without direct contact to effect development without causing ground fog. Through these factors, excellent images can be obtained.

In order to fix the toner image thus developed, the heat-fixing system is generally adopted wherein the toner is heated and melted by an infrared radiation heater or a heating roller to be fusion-stuck onto a supporting medium. For the reasons such as prevention of the danger of fire and saving of power, the pressure-fixing system using rigid rollers is gradually being adopted in place of the heat-fixing system. Particularly, this pressure fixing system is advantageous in many respects such that no fear of scorching of copied sheets is involved, that copying operation can be started immediately after turning on the power source and without requiring any waiting time, that high speed fixing is possible, and that the fixing apparatus is simple.

However, the conventional toner cannot be applied to the pressure fixing system as it is. This is because toners are made of materials which are chosen so as to be adapted for the respective fixing methods, and, generally speaking, a toner applicable for a specific fixing method cannot be used for another fixing method. Particularly, it is impossible to utilize a toner for heat fusion fixing with an infrared radiation heater as a toner for hot roller fixing. Much less, there is no exchangeability at all between the toner for heat fixing and the toner for pressure fixing. Accordingly, toners have been developed so as to be adapted for individual fixing methods, and several proposals have been made to impart toner characteristics adapted for pressure fixing to the one-component toner having excellent development characteristic as mentioned above while retaining the advantages of the one-component toner.

For such a pressure-fixable toner, particularly, the constituent resin is required to have characteristics suitable for pressure fixing, and the resins suited for this purpose are actively being developed. However, no practical pressure-fixable toner has yet been obtained, which is excellent in pressure fixability, without causing off-set to the pressure rollers, stable in developing and fixing performances during repeated uses, without causing adhesion onto carriers, metal sleeve or the surface of a photosensitive member, and also stable in storage stability without agglomeration or caking during storage. Particularly, with respect to pressure fixability, a problem remains in fixability onto plain paper.

In order to satisfy various properties required for the toner for pressure fixing, by using toners having a plurality of layers, several capsule toners have been proposed, wherein a shell of a hard resin is provided. Among such proposals, for example, there are a capsule toner comprising a core of a soft material as disclosed by U.S. Pat. No. 3,788,994 and a capsule toner comprising a core of a soft resin solution. However, these capsule toners still have many unsolved problems such as insufficient pressure-fixability and off-set phenomenon and has not been reduced to commercial practice. Further, as the shell material for such capsule toners, vinyl polymers, which have been used as a binder of the toner for heat fixation, are used. These vinyl powders generally have a relatively small number-average molecular weight and a ratio of weight-average molecular weight-/numberaverage molecular weight of 4 or larger. However, when a vinyl polymer having such physical properties is used as a shell material in the capsule toners as mentioned above, the shell material does not have a sufficient strength nor has a sufficient durability as required for developers. Accordingly, the shell materials are often separated to contaminate or adhere onto the surfaces of the development sleeve, the photosensitive member, the carrier particles, etc. On the contrary, if the shell is made so thick as to satisfy the strength, the fixability of the toner becomes remarkably degraded.

SUMMARY OF THE INVENTION

An object of the present invention is to provide a pressure-fixable capsule toner free from defects as mentioned above through improvement in the shell material.

A specific object, among others, of the present invention is to provide a pressure-fixable toner showing a good fixability onto plain paper at a lower pressure than before and excellent in durability so that it does not cause contamination or adhesion onto the surfaces of a development sleeve, a photosensitive member and carrier particles.

Another object of the present invention is to provide a pressure-fixable capsule toner showing excellent and stable charge-controlling characteristic.

A further object of the present invention is to provide a pressure-fixable capsule toner which shows good pressure fixability and development characteristic and is electrostatically transferable even when it is made into a toner for the one-component system developer by containing magnetic fine particles.

A still further object of the present invention is to provide a development method using a pressure-fixable capsule toner as mentioned above.

As a result of our studies, it has been discovered very effective to use a vinyl polymer having a specific range of molecular weight and a narrow molecular weight distribution in order to accomplish the above mentioned objects.

The pressure-fixable capsule toner is based on the above knowledge and, more specifically, comprises a core material comprising a pressure-fixable component, and a shell material covering the core material, the shell material comprises a vinyl polymer having a number-average molecular weight of 6000 to 50000 and a ratio of weight-average molecular weight/number-average molecular weight of not larger than 3.5.

The present invention will be described in further detail below, when necessary, by referring to the accompanying drawings. In the following description, unless specifically otherwise noted, "parts" and "%" are by weight.

DETAILED DESCRIPTION OF THE INVENTION

Figure 1:
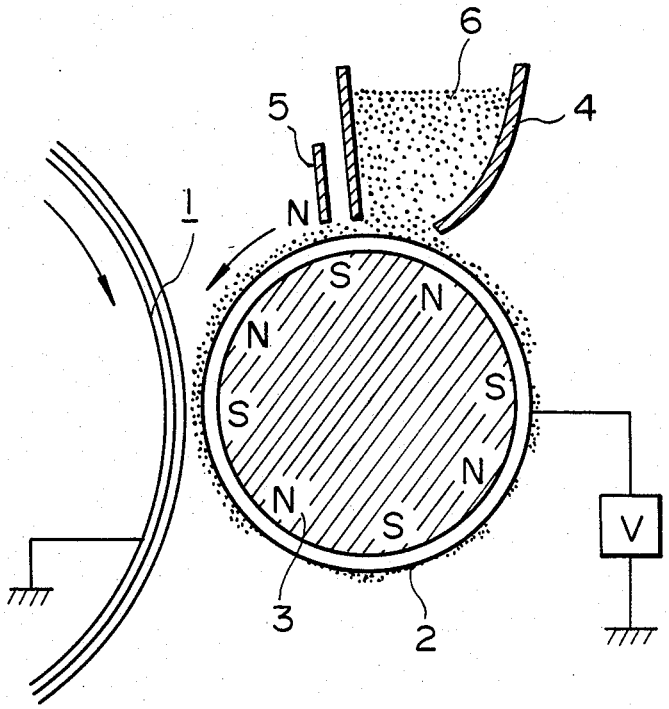
FIGS. 1 and 2 respectively show a sectional view illustrating an embodiment of the development step to which the capsule toner of the invention is suitably applied.

The core material of the capsule toner of the invention basically comprises fine particles of a resinous material as the pressure-fixable component, and a colorant and optionally a magnetic material, dispersed in the resinous material.

As the resinous pressure-fixable component constituting the core material, polyethylene and paraffin wax are especially preferred. As the polyethylene, those showing a melt viscosity of not higher than 600 cps at 140° C. are preferred, which are generally referred to as low-molecular weight polyethylene or polyethylene wax and produced through polymerization or decomposition. Examples of the commercially available products thereof include the following:

AC Polyethylene #9 (mfd. by Allied Chemical Inc.) (0.94 g/cm$^3$, 350 cps)

Hiwax 310P (mfd. by Mitsui Sekiyu K.K.) (0.94 g/cm$^3$, 250 cps)

Hiwax 310P (mfd. by Mitsui Sekiyu K.K.) (0.94 g/cm$^3$, 550 cps)

Hiwax 405P (ditto) (0.96 g/cm$^3$, 550 cps)

Hiwax 400P (ditto) (0.97 g/cm$^3$, 550 cps)

Commercially available products showing a melt viscosity of not higher than 150 cps and a density of 0.94 g/cm$^3$ or above include the following:

Hiwax 200P (mfd. by Mitsui Sekiyu K.K.) (0.97 g/cm$^3$, 70 cps)

Hoechst Wax PE130 (mfd. by Hoechst A.G.) (0.95 g/cm$^3$, 117 cps)

Commercially available paraffin wax includes those shown in Tables 1 and 2 below:

TABLE 1

| Paraffin Wax and Micro Wax (mfd. by Nihon Sekiyu K.K.) | |
|---|---|
| Trade Name | m.p. °C. |
| Nisseki #1 Candle Wax | 59.7 |
| Nisseki #2 Candle Wax | 62.0 |
| 125° Paraffin | 54.3 |
| 130° Paraffin | 56.5 |
| 135° Paraffin | 59.7 |
| 140° Paraffin | 61.9 |
| 145° Paraffin | 63.2 |
| 125° FD Paraffin | 53.8 |
| Paraffin Wax (M) | 54.1 |
| 125° Special Paraffin | 54.2 |
| Nisseki Micro Wax 155 | 70.0 |
| Nisseki Micro Wax 180 | 83.6 |

TABLE 2

| Paraffin Wax (Nihon Seiro K.K.) | | | |
|---|---|---|---|
| Trade Name | m.p. °C. | Trade Name | m.p. °C. |
| 155 | 70 | SP-0145 | 62 |
| 150 | 66 | SP-1035 | 58 |
| 140 | 60 | SP-1030 | 56 |
| 135 | 58 | SP-3040 | 63 |
| 130 | 55 | SP-3035 | 60 |
| 125 | 53 | SP-3030 | 57 |
| 120 | 50 | FR-0120 | 50 |
| 115 | 47 | | |

In the present invention, it is preferred to use an appropriate combination of the polyethylene and the paraffin wax. Of course, if necessary, several kinds of the polyethylene and the paraffin wax, respectively, may also be used in combination.

When the polyethylene and paraffin wax are used in combination, it is preferred to use them in a weight ratio of 8/2 to 0/10, particularly 6/4 to 1/9.

Into the core material of the capsule toner of the present invention, known dyes, pigments, etc. may be incorporated as a colorant. Illustrative of such colorants are carbon black of various species, Aniline Black, Naphthol Yellow, Molybdenum Orange, Rhodamine Lake, Alizarin Lake, Methyl Violet Lake, Phthalocyanine Blue, Nigrosine Methylene Blue, Rose Bengal, Quinoline Yellow and others.

When the capsule toner of the present invention is used as a magnetic toner, magnetic powder may be incorporated in the core material. As the magnetic powder, those of ferromagnetic elements such as iron, cobalt, nickel or manganese and alloys or compounds containing these elements such as magnetite, ferrite, etc., may be employed. The magnetic powder may also function as a colorant. The content of the magnetic powder may be 15 to 70 parts per 100 parts with respect to the total resin or pressure-fixable component in the core material.

Also, in order to impart a free flowing property or to effect charge controlling or for any other purpose, it is possible to further incorporate colloidal silica, a metal soap, etc., into the capsule toner of the present invention.

The core material of the capsule toner according to the present invention may be prepared, for example, by melting and kneading the components as described above, micropulverizing the mixture, and further by classification, as desired, into fine particles will an average particle size of 5 to 15 microns.

The capsule toner of the present invention may be prepared by covering or coating the core material with a shell material comprising a vinyl polymer having a number-average molecular weight of 6000 to 50,000 and a ratio of weight-average molecular weight/number-average molecular weight of not larger than 3.5.

The vinyl polymer may be a homopolymer of a monomer or a copolymer of two or monomers, for example, selected from the following:

Styrene monomers including styrene and its derivatives such as styrene, o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, and p-n-dodecylstyrene; ethylenically unsaturated monoolefins such as ethylene, propylene, butylene, and isobutylene; vinyl halides such as vinyl chloride, vinylidene chloride, vinyl bromide, and vinyl fluoride; vinyl esters such as vinyl acetate, vinyl propionate, and vinyl benzoate; α-methylenealiphatic monocarboxylates such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, and phenyl methacrylate; methyl α-chloromethacrylate, maleic acid, malic acid esters; acrylates such as methyl acrylate, ethyl acrylate, n-butyl acrylate, iso-butyl acrylate, propyl acrylate, n-octyl acrylate, dodecyl acrylate, 2-ethylhexyl acrylate, stearyl acrylate, 2-chloroethyl acrylate and phenyl acrylate; vinyl ethers such as vinyl methyl ketone, vinyl hexyl ketone, and methyl isopropenyl ketone; N-vinyl compounds such as N-vinylpyrole, Nvinylcarbazole, N-vinylindole, and N-vinylpyrrolidone; vinylnaphthalenes; derivatives of acrylic acid and methacrylic acid such as acrylonitrile, methacrylonitrile, and acrylamide; tertiary amino group-containing vinyl monomers such as dimethylaminoethyl methacrylate, dimethylphenyl acrylate, dimethylaminopropyl acrylamide, and diethylaminoethyl methacrylate.

Among these, copolymers of a styrene monomer and a tertiary amino group-containing vinyl monomer are especially preferred because they also have a charge controlling characteristic. Preferred molar copolymerization ratio between the styrene monomer and the tertiary amino group-containing vinyl monomer is within the range of 1:0.01 to 1:0.5.

According to the present invention, the vinyl polymer is required to have a number average molecular weight of 6000 to 50,000 and a ratio (Mw/Mn) of weight-average molecular weight (Mw)/number-average molecular weight (Mn) of not larger than 3.5. When the shell is constituted of a vinyl polymer having an Mn of less than 6000 as a major constituent, the shell cannot have a sufficient strength and results in a toner with a poor durability. On the other hand, when a vinyl polymer having Mn of above 50,000 is used, the polymer solution for encapsulation becomes too viscous and results in frequent coalescence and aggregation of the particles, whereby the resultant capsules comprise more than one cores and are made too large. For the same reason and for giving a uniform strength of polymer shell, the vinyl polymer is desired to have a narrow molecular weight distribution and should have a ratio (Mw/Mn) of not larger than 3.5. Further to say, it is desired that the vinyl polymer has an Mn of not larger than 40,000, especially not larger than 30,000 from the view points of provention of colescence and aggregation.

The vinyl polymer satisfying the above molecular weight conditions can be prepared by regulation of the polymerization conditions for preparation thereof, by fractionation of constituent polymers prepared in advance, or by combination of these. The regulation of polymerization conditions can be effected by regulation of a concentration of monomer, polymerization initiator and/or chain transfer agent during the bulk polymerization, the solution polymerization, the suspension polymerization, the emulsion polymerization, etc., or by the living polymerization using an anionic initiator or the cationic polymerization. Further, fractionation of constituent polymers can be effected, typically, by fractional precipitation, fractional dissolution, column fractionation and gel permeation chromatography (GPC).

The values of Mn and Mw/Mn used for defining the present invention have been obtained by GPC under the following measurement conditions.

Thus, tetrahydrofuran was first caused to flow at a rate of 1 ml/min. through a GPC column (Shodex A 80M commercially available from Showa Denko K.K. Japan) and then a 0.1% sample polymer solution in tetrahydrofuran was injected for measurement in a volume of 300 to 500 ml to the column. Before measurement of the molecular weight of a sample polymer, a calibration curve was prepared by using several monodisperse standard polystyrene samples and the conditions such as the sample concentration and the sensitivity of a detector were adjusted so that the resultant calibration curve (log. molecular weight vs. count (accumulated volume of eluate) would assume a linearity. In the above measurement, the reliability was checked whether or not the measurement according to the above conditions of NBS 706 standard polystyrene sample (available from General Science, Corp.) gave an Mw/Mn value of 2.11±0.10. The measurement was conducted by a GPC instrument, Model 150 manufactured by Waters Associate, Inc.

In the present invention, it is possible to use a mixture of two or more species of the above mentioned vinyl polymers. In the case of such a mixture of vinyl polymers, each of the individual vinyl polymers need not satisfy the above mentioned molecular weight conditions, but it is sufficient that the resultant polymer mixture satisfies the above conditions of Mn of 6000 to 50,000 and Mw/Mn of not larger than 3.5. The vinyl polymer may be mixed with less than 75% thereof of other resins. Example of such other resins include styrene copolymers such as styrene-butadiene copolymer, styrene-isoprene copolymer, and styrene-acrylonitrile-indene copolymer; polyesters, polyurethanes, polyamides, epoxy resins, polyvinyl butyral, rosin, modified rosin, terpene resins, phenol resins, aliphatic or alicyclic hydrocarbon resins, aromatic petroleum resins, chlorinated paraffin and paraffin waxes. These additional resins may also be used singly or as a mixture of two or more thereof.

In order to obtain a capsule toner comprising a shell of the vinyl polymer as mentioned above, several known encapsulation techniques are available. For example, the spray drying method, the coacervation method and the phase separation method are suitably applied. Moreover, the in-situ polymerization method, and the methods as disclosed by U.S. Pat. Nos. 3,338,991; 3,326,848; and 3,502,582 can also be used.

The capsule toner according to the present invention thus obtained generally takes the form of microcapsular particles having a shell of 0.05 to 0.5 micron in thickness and an average particle size of 5 to 18 microns.

As described hereinabove, according to the present invention, a pressure-fixable capsule toner provided with durability, pressure fixability and developing characteristic in combination by using a vinyl polymer having specific ranges of molecular weight and molecular weight distribution as the shell forming resin.

The pressure-fixable capsule toner according to the present invention is applicable to various development methods. The pressure-fixable capsule toner of the invention, however, is not free from crushing during development because it usually contains a soft core material. Accordingly, the capsule toner of the present invention is especially suitably used for development methods using no carrier particles which can cause undesirable crushing or rupture of the capsules during the development through application of irregular pressing force. One preferred mode of such a development method using no carrier particles but the capsule toner of the invention may be characterized by the features of providing an electrostatic image bearing member for bearing electrostatic images on its surface and a toner carrying member for carrying toner particles on its surface arranged with a predetermined gap therebetween at the developing section, causing a capsule toner of the invention to be carried in a thickness thinner than said gap on the toner carrying member, and transferring the capsule toner to the abovementioned electrostatic image bearing member at the developing station, thereby to effect development. A specific example of such a developing method using no carrier particles is represented by the magnetic brush method as diclosed in U.S. Pat. No. 2,786,439. Furthermore, the capsule toner of the present invention are applicable to development methods as explained in FIGS. 1 and 2, as specific examples of the above explained development method using no carriers.

FIG. 1 illustrates an example of such a development method wherein a magnetic capsule toner according to the present invention is applicable. In this example, an electrostatic image bearing member 1 constituted of a photoconductive material, moves in the direction of the arrow. A non-magnetic cylinder 2 as a toner carrying member rotates so as to travel in the same direction as the movement of the surface of the electrostatic image bearing member 2 at the developing section. Inside the non-magnetic cylinder 2 is provided a multi-polar permanent magnet 3 so as not to be rotated. Toner 6 delivered from a toner vessel 4 is coated on the surface of the non-magnetic cylinder 2, and a charge of opposite polarity to that of the electrostatic image to the toner particles through friction between the toner particles and the cylinder surface. Further, a doctor blade 5 made of iron is brought to near the surface of the cylinder (gap of 50 to 500 microns) and arranged to confront one magnetic pole (S-pole in the figure) of the multipolar permanent magnet 9, whereby the toner layer thickness is evenly regulated to be thin (30 microns to 300 microns) so as to be thinner than the gap between the surfaces of the non-magnetic cylinder 2 and the electric image bearing member 1 at the developing section. By controlling the rotational speed of the cylinder 2, the surface layer speed and preferably also the internal speed of the toner layer are made substantially equal to or approximate to the surface speed of the electrostatic image bearing member 1. As the doctor blade 5, a permanent magnet may be employed in place of an iron to form a counter-pole. Also, an alternating bias voltage may be applied between the toner carrying member and the electrostatic image bearing surface at the developing section. This alternating bias voltage may have a frequency of 200 to 4000 Hz and Vpp (peak-to-peak voltage) of 500 to 3000 V. Thus, the toner at the developing section is transferred to the electrostatic image side through the action of attracting force exerted by the electrostatic image or by the action of the alternating bias voltage, whereby development is effected.

Figure 2:
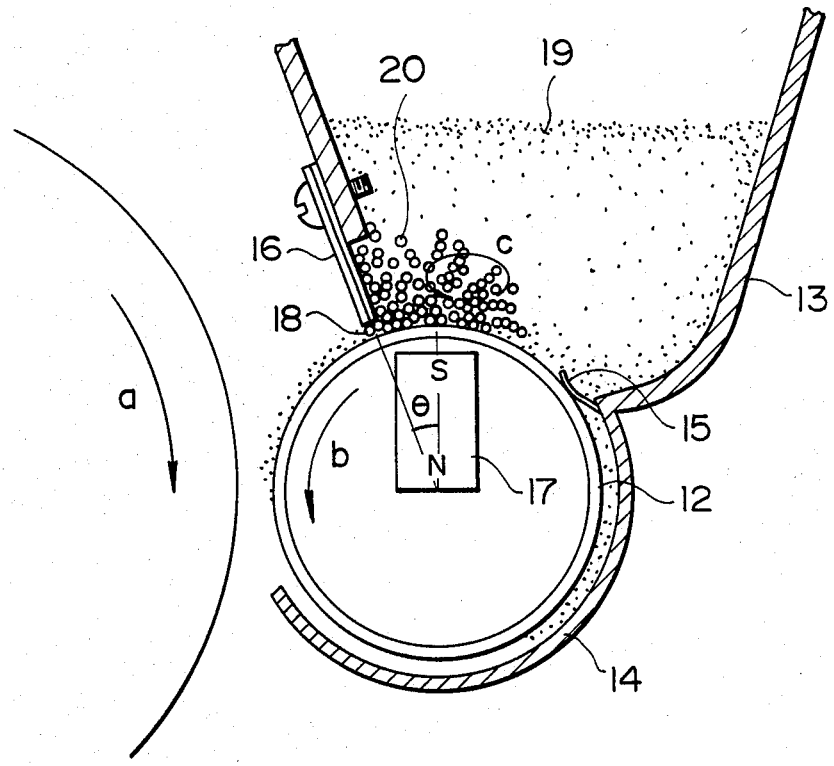

FIG. 2 illustrates an example of the development method wherein a non-magnetic pressure-fixable capsule toner may be suitably used. In the example, an electrostatic image bearing member 11 rotates in the direction of arrow. Opposed to the surface of the image bearing member 11 with a gap, a cylindrical member for carrying toner is provided and caused to rotate in the direction of arrow b. A toner supply container 13 is provided to supply the toner to the toner carrying member 12. The toner container 13 is provided with an enclosure member 14 below it so as to enclose the lower part of the toner carrying member 12. At the transitional part between the container 13 and the enclosure member 14 is provided a sealing member 15 so as to prevent the leakage of the toner. At the outlet of the container 13 is provided a magnetic blade 16 of a magnetic material. At the opposite side of the magnetic blade 16 across the toner carrying member is provided a magnet 17. The magnet 17 is, however, not right across from the magnetic blade but displaced by a predetermined angle $\theta$(5–50 degrees) (angle defined between the direction of from the center of the carrying member to the magnetic blade and the direction of from the center of the carrying member to the confronting magnetic pole of the magnet 17) toward upstream with respect the direction of the movement of the toner carrying member 12.

Into the container 13 of the above-described structure, toner particles 19 and magnetic particles 20 are supplied so that a magnetic brush 18 of the magnetic particles is formed in a zone between the magnetic blade 16 and the part of the surface of the toner carrying member to which the magnet is confronted. Due to the rotation of the cylindrical toner carrying member 12, the toner particles and magnetic particles are agitated and mixed, whereby the toner particles are triboelectrically charged through friction thereof with the magnetic particles and the toner carrying member.

The thus triboelectrically charged toner particles are separated from the magnetic brush and coated as a thin layer of uniform thickness on the toner carrying member by the action of the magnetic brush and the image force. On the other hand, the magnetic particles forming the magnetic brush are not coated nor moved along with the toner particles on the cylindrical toner carrying member, because the magnetic confining or finding force acting on the magnetic particles exerted by the magnet 7 is set larger than the driving force exerted thereon which is dependent on the electrostatic attracting force and the mechanical force of friction acting between the magnetic particles and the toner carrying member.

In the ordinary state, if the toner is present in the magnetic brush zone, the ratio between the toner and the magnetic particles thereon becomes constant in the magnetic brush zone.

More specifically, when the toner coated on toner is consumed by using it for development in a known manner, an additional amount of toner is supplied to the magnetic brush zone, whereby a constant amount of coated toner is always available. The toner thus coated is transferred to the electrostatic image side through the action of attracting force exerted by the electrostatic image or by the action of an alternating bias voltage, whereby development is effected similarly as explained with reference to FIG. 1.

The present invention will now be explained with reference to the actual example of practice.

EXAMPLE 1

A core material was prepared by melt-mixing 20 parts of Hiwax 200P (mfd. by Mitsui Sekiyu Kagaku K.K.), 80 parts of Paraffin Wax 155 (mfd. by Nihon Seiro K.K.), 60 parts of magnetite at 150° C., followed by granulation by spray drying and dry-classification, into spherical particles with particle sizes of $10.3\mu \pm 5.0\mu$.

The core particles were coated with a $0.4\mu$-thick film of styrene-dimethylaminoethylmethacrylate copolymer (mol ratio of 90/10) having an Mn of 13382 and a ratio Mw/Mn of 2.94 through phase separation from an organic solution, thus obtaining capsule particles.

Then, 100 g of the capsule particles was mixed with 0.4 g of hydrophobic colloidal silica (mfd. by Nihon Silica Kogyo K.K.) by means of a coffee mill to obtain a developer. This developer in an amount of 1 g was mixed with 9 g of iron powder (200–300 mesh) and the triboelectric charge thereof was measured in a known manner to be $+18.4\ \mu C/g$. The developer was then applied to a developing apparatus which has a non-magnetic sleeve enclosing a magnet to develop a latent image having negative electrostatic charge. The developed image was then transferred to wood-free paper. The paper having the toner image was passed through a pressure fixing instrument having a pair of pressure rollers arranged to apply a pressing force from the both faces, whereby substantially complete fixing performance was attained at a speed of 125 mm/sec under a line pressure of 10 kg/cm. The image density was 1.3, and the reversed image formed was good and clear without fog.

Further, in the developing apparatus, after 8 hours of blank rotation continued for durability test, development and transfer were conducted again. As the result, the resultant image density was 1.5 without change in image quality, thus indicating good durability. The triboelectric charge was $+19.3\ \mu C/g$. No contamination or adhesion was observed on the sleeve surface. When the toner surface was observed by an electron microscope, no peel-off of the shell was found.

COMPARATIVE EXAMPLE 1

The core material of Example 1 was encapsulated in substantially the same manner as in Example 1 except that styrene-dimethylaminoethyl methacrylate copolymer (mol ratio of 90/10) having an Mn of 5308 and an Mw/Mn ratio of 2.30 was used as the shell material. The resultant capsule particles were similarly mixed with the hydrophobic colloidal silica to prepare a developer as in Example 1. The triboelectric charge of this developer was $+19.8\ \mu C/g$.

This developer was tested in the same manner as in Example 1. As the result, the image obtained at the initial stage of the copying test showed similar fixability and image quality and were found to be good with an image density of 1.2, whereas the images obtained after the 8 hours of blank rotation showed a lower density of 0.6 and were accompanied with fog. The triboelectric charge had increased to $+27.5\ \mu C/g$. On the development sleeve, streak-like adhesion was observed. When the toner surface was observed by an electron microscope, partial peel-off of the shell was observed.

EXAMPLES 2–7 & COMPARATIVE EXAMPLES 2–5

The procedure of Example 1 was repeated except for replacing the shell-forming resin with those shown in the following table. The results are also shown in the following table.

TABLE

| | Shell-forming polymer | | Before durability test | | After durability test | |
|---|---|---|---|---|---|---|
| | Kind of polymer | Molecular-weight conditions | Triboelectric charge ($\mu C/g$) | Quality of image | Triboelectric charge ($\mu C/g$) | Adhesion etc. |
| Example 2 | Styrene/dimethylaminoethyl methacrylate copolymer (mol ratio: 90/10) Styrene/methylmethacrylate copolymer | $\overline{Mn} = 7214$ Mw/Mn = 2.19 | +16.4 | Good | +18.0 | None |

TABLE-continued

| | Shell-forming polymer | | Before durability test | | After durability test | |
|---|---|---|---|---|---|---|
| | Kind of polymer | Molecular-weight conditions | Triboelectric charge (μC/g) | Quality of image | Triboelectric charge (μC/g) | Adhesion etc. |
| | (mol ratio: 50/50) (weight ratio of the copolymers: 7/3) | | | | | |
| Example 3 | Styrene/2-vinylpyridine copolymer (mol ratio: 90/10) | $\overline{Mn}$ = 8460 $\overline{Mw}/\overline{Mn}$ = 2.41 | +17.9 | Good | +19.4 | None |
| Example 4 | Styrene/P—N,N—dimethylaminophenyl acrylate copolymer (mol ratio: 90/10) | $\overline{Mn}$ = 16744 $\overline{Mw}/\overline{Mn}$ = 3.07 | +18.7 | Good | +19.9 | None |
| Comparative Example 2 | Styrene/dimethylaminoethyl methacrylate copolymer (mol ratio: 90/10) | $\overline{Mn}$ = 7630 $\overline{Mw}/\overline{Mn}$ = 3.77 | +17.1 | Good | +26.4 | Found |
| Comparative Example 3 | Styrene/dimethylaminoethylmethacrylate/n-butylacrylate copolymer (mol ratio: 65.5/10/24.5) | $\overline{Mn}$ = 56984 $\overline{Mw}/\overline{Mn}$ = 1.80 | +16.9 | Bad *1 | — | — |
| Example 5 | Styrene/dimethylaminoethyl methacrylate copolymer (mol ratio: 80/20) | $\overline{Mn}$ = 45210 $\overline{Mw}/\overline{Mn}$ = 2.58 | +15.0 | Fair *2 | +18.7 | None |
| Example 6 | Styrene/dimethylaminoethyl methacrylate copolymer (mol ratio: 90/10) | $\overline{Mn}$ = 49037 $\overline{Mw}/\overline{Mn}$ = 3.06 | +14.4 | Fair *2 | +17.9 | None |
| Example 7 | Styrene/dipropylaminoethyl methacrylate copolymer (mol ratio: 90/10) | $\overline{Mn}$ = 46750 $\overline{Mw}/\overline{Mn}$ = 2.98 | +16.9 | Fair *2 | +19.8 | None |
| Comparative Example 4 | Styrene/diethylaminoethyl methacrylate copolymer (mol ratio: 90/10) | $\overline{Mn}$ = 4520 $\overline{Mw}/\overline{Mn}$ = 1.50 | +17.4 | Fair *2 | +24.6 | Found |
| Comparative Example 5 | Styrene/diethylaminoethyl methacrylate copolymer (mol ratio: 90/10) | $\overline{Mn}$ = 72850 $\overline{Mw}/\overline{Mn}$ = 4.9 | +13.5 | Bad *1 | — | — |

*1: Bad, Polynuclear particles
*2: Good, but with a slightly lower resolution

EXAMPLE 8

A core material was prepared by melt-mixing 40 parts of AC-Polyethylene #9 (mfd. by Allied Chemical, Inc.), 60 parts of Paraffin Wax 155 and 5 parts of Phthalocyanine Blue and granulated as in Example 1 into blue spherical particles with particle sizes of 9.1±4.5μ.

The core particles were coated with a 0.5 μ-thick film of styrene-dimethylaminopropylacrylamide (mol ratio of 90/10) having an Mn of 13382 and an Mw/Mn ratio of 2.94 by the spray drying method.

The resultant capsule particles in an amount of 100 g were dry-mixed with 0.60 g of hydrophobic colloidal silica and the resultant mixture were further mixed with iron powder of 200–300 mesh in size in a weight proportion of 1/9 to prepare a developer. The developer was used to develop a negatively charged electrostatic image and the resultant toner image was transferred to wood-free paper and fixed thereon under the same fixing conditions as in Example 1, whereby well-fixed and clear reversed images were obtained with a density of 1.3 and without fog.

The developer was then subjected to a successive copying test of 3000 sheets with an A-4 size original, no contamination or adhesion was found on any of the development sleeve, photosensitive member and carrier surfaces after the copying test, and good quality of images without fog were invariably obtained.

COMPARATIVE EXAMPLE 6

The core particles of Example 8 were coated with a 0.5 μ-thick film of styrene-dimethylaminopropylacrylamide (mol ratio of 90/10) having an Mn of 4720 and an Mw/Mn ratio of 3.75 as in Example 8. The capsule particles were mixed with the hydrophobic colloidal silica and the carrier particles as in Example 8 to obtain a developer.

The developer was tested in substantially the same manner as in Example 8, whereby the resultant images obtained at the initial stage were good in any of fixability, image density and image quality. However, in the successive copying test using an A-4 size original, contamination of the development sleeve and adhesion onto the photosensitive member were observed after copying 1200 sheets. Moreover, decrease in image density and ground fog due to poor cleaning were observed, whereby the toner was found to leak in durability.

What is claimed is:

1. A pressure-fixable capsule toner, which comprises a core material comprising a pressure-fixable component and a shell material covering the core material, wherein the shell material comprises a copolymer of styrene or a derivative thereof and a tertiary amino-group containing vinyl monomer, and the copolymer has a number-average molecular weight of 6,000 to 50,000 and a ratio of a weight-average molecular weight/number-average molecular weight of not larger than 3.5.

2. The pressure-fixable capsule toner according to claim 1, wherein the copolymer is styrene-dimethylaminoethylmethacrylate copolymer.

3. The pressure-fixable capsule toner according to claim 1, wherein said core material further contains magnetic powder dispersed in the pressure-fixable component.

4. The pressure-fixable capsule toner according to claim 1, wherein said pressure-fixable component is selected from the group consisting of polyethylene and paraffin wax.

5. A development method, which comprises:

providing an electrostatic image bearing member for bearing electrostatic images on its surface and a toner carrying member for carrying toner particles on its surface arranged with a predetermined gap therebetween at a developing section, causing a pressure-fixable capsule toner to be carried on the toner carrying member, said pressure-fixable capsule toner comprising a core material comprising a pressure-fixable component and a shell material at least partially covering the core material, said shell material comprising a copolymer of a styrene or a derivative thereof and a tertiary amino-group containing vinyl monomer, said copolymer having a number-average molecular weight of 6.000 to 50,000 and a ratio of weight-average molecular weight/number-average molecular weight of not larger than 3.5, and transferring the capsule toner to the electrostatic image bearing member at the developing section, thereby to effect development.

6. The development method according to claim 5, wherein the capsule toner is carried in a thickness thinner than the gap between the surface of the toner carrying member and the surface of the electrostatic image bearing member at the developing section.

7. The development method according to claim 5, wherein the the capsule toner is transferred to the electrostatic image bearing member at the developing section, while an alternating bias voltage is applied between the toner carrying member and the electrostatic image bearing surface at the developing section.

* * * * *